United States Patent [19]

Boulanger

[11] Patent Number: 5,016,299

[45] Date of Patent: May 21, 1991

[54] EMERGENCY EVACUATION HARNESS

[76] Inventor: Claude Boulanger, 1212 Pine Avenue West, Apt. No. 405, Montreal, Quebec, Canada, H3G 1A9

[21] Appl. No.: 469,240

[22] Filed: Jan. 24, 1990

Related U.S. Application Data

[63] Continuation-in-part of Ser. No. 355,415, May 23, 1989, abandoned.

[51] Int. Cl.[5] ..... A61G 7/10; A61G 7/08

[52] U.S. Cl. ..... 5/81 R; 5/82 R; 294/74; 294/140

[58] Field of Search ..... 5/508, 82 R, 81 R, 494, 5/424, 485, 510; 294/70, 140; 128/864, 872

[56] References Cited

U.S. PATENT DOCUMENTS

| | | | |
|---|---|---|---|
| Re. 28,916 | 7/1976 | Rice | 5/82 R |
| 2,675,564 | 4/1954 | Hughes | 5/82 R |
| 2,788,530 | 4/1957 | Ferguson | 5/82 R |
| 3,273,177 | 9/1966 | Newton . | |
| 3,639,926 | 2/1972 | Steelman | 5/82 R |
| 3,721,434 | 3/1973 | Spies | 269/328 |
| 3,757,359 | 9/1973 | Stellman | 5/82 R |
| 4,104,750 | 8/1978 | Kelter et al. | 5/93.1 |
| 4,369,982 | 1/1983 | Hein et al. | 5/82 R |
| 4,485,504 | 12/1984 | Lehmann | 5/82 R |
| 4,534,075 | 8/1985 | Schnitzler | 5/82 R |

FOREIGN PATENT DOCUMENTS

| | | |
|---|---|---|
| WO86/07253 | 12/1986 | European Pat. Off. . |
| 1434832 | 5/1976 | United Kingdom . |
| 2030047A | 4/1980 | United Kingdom . |

*Primary Examiner*—Alexander Grosz

[57] ABSTRACT

An emergency evacuation harness, such as is used for evacuating immobile patients, or similar persons, comprises a bottom harness member for positioning beneath a mattress with longitudinally extending straps extending from one end. In use the longitudinal straps are brought over the mattress, with fastening members on the straps engaging with attachment members on the sides of the bottom harness member. In one form the bottom member is in the form of transverse and longitudinal straps. In a further form the bottom harness member can form part of a structure enclosing a mattress, a preferred arrangement being of the form in which the bottom member is composed of transverse and longitudinal straps extending to form transverse and longitudinal loops enclosing the mattress.

34 Claims, 5 Drawing Sheets

48
37
36
35
34
30
60
33
32
31
40
44
26
10
21
28
27
25
24
22
41
42
V
VI
34a
34b
34c
34d

EMERGENCY EVACUATION HARNESS

This application is a continuation in part of Ser. No. 355,415 filed May 23, 1989, now abandoned.

This invention relates to an emergency evacuation harness, and particularly to such a harness for use in hospitals and other establishments having immobile persons, for evacuation of such persons. The invention also relates to a mattress cover embodying the harness and to a mattress incorporating the harness.

It has been proposed, for emergency evacuation of hospital patients who are bedridden, to use straps which extend under a mattress and pass up and over the patient. When the straps are tightened, the mattress is drawn up partly around the patient. A handle is provided at one end, or both ends, for pulling the mattress and patient to a safe place.

In some arrangements, straps are positioned beneath the mattress, extending laterally. A sufficient length must be provided to pass up and over the patient and mattress, the ends often hang down, being inconvenient, and interfering with cleaning. In other arrangements, a sheet of material is positioned below the mattress, with lateral straps being attached to the sheet of material. Again, enough length of strap must be provided to extend up and over the patient and mattress. It has been proposed to provide retaining means at the sides of the mattress to hold the excess lengths of strap, until needed. Where a sheet of material is provided, the straps can be held on the material, in a folded condition. Straps extending over the ends of the mattress are also provided to position the patient longitudinally on the mattress when the straps are in use. Again, provision can be made to hold these straps against hanging down when not in use.

The present invention provides a harness which can be fitted to a mattress, with external longitudinally extending straps which are normally stored at one end, but which, in use, extend over the mattress, and the patient, from one end to the other end. The longitudinal straps are provided with fastening means for engaging with attachment means on the harness at the sides of the mattress. The longitudinal straps extend to the other end of the mattress and form a handle for pulling the mattress along.

Broadly the invention comprises a bottom harness member for positioning beneath a mattress, the harness member having longitudinally spaced attachment means on each side, a plurality of longitudinal straps extending from one end and extendable in use over said/the mattress and a patient on said mattress, to the other end of the mattress, fastening means on said straps positioned to engage with said attachment means and fasten said straps over said mattress and said patient. Transversely extending members maintain the longitudinal straps in spaced relationship. Longitudinal straps can attach to the harness member at said other end and can extend to form a handle.

The harness member can be of various forms, and in one embodiment is formed by a plurality of straps arranged in a grid-like configuration. The attachment means can be fastened to transversely extending straps and the longitudinal straps can be attached at one end of the longitudinally extending straps of the grid-like configuration, or can be extensions thereof.

In another form, the invention comprises a harness having a plurality of transverse straps forming transverse loops, at least one longitudinal strap forming a longitudinal loop, the transverse and longitudinal straps forming a grid-like structure, with attachment means on said transverse loops at each side; and further external longitudinal straps extending from one end of the longitudinal loops, the further external longitudinal straps including fastening means engaging with the attachment means when the further, external, longitudinal straps are positioned over a mattress, extending to the other end of said longitudinal loops and forming a handle at said other end.

In a particular embodiment, the harness is attached to the inside of a mattress cover, the mattress cover being open at the end remote from the further external straps, so that a mattress can be pushed into the cover. Conveniently the open end is closed by flaps having hook and loop fastening material, such as is sold under the trade mark "Velcro".

In still another embodiment, there is provided an emergency evacuation harness for fitting around a mattress for moving immobile persons, said harness comprising a plurality of transverse straps, each forming a transversely extending loop adapted to transversely envelope said mattress; at least one longitudinal strap forming a longitudinally extending loop adapted to longitudinally envelope said mattress, said longitudinally extending loop and said transversely extending loops forming a grid-like structure; attachment means on each said transverse loops, said attachment means at each side; further longitudinal straps extending from one end of said harness, and connected to said longitudinally extending loop at said one end, and adapted to overlie a patient on said mattress; fastening means on said further longitudinal straps, said fastening means positioned to align with and connect to said attachment means when said further longitudinal straps extend over said transversely extending loops from said one end to the other end; whereby said longitudinally extending loop and said transverse loops are adapted to hold said mattress in said harness, and said further longitudinal straps, with said attachment means and said fastening means, are adapted to hold a patient on said mattress.

In another embodiment, there is provided an emergency evacuation harness for fitting over a bedding component and a patient for moving immobile persons, the improvement comprising a harness assembly adapted to overlie a bedding component, said assembly having a plurality of longitudinal straps extending from one end of said bedding component, said longitudinal straps extendable in use over said bedding component from one end thereof to an opposed end and to overlie a patient on said bedding component; spaced fastening means on said longitudinal straps positioned to engage with side attachment means when said longitudinal straps extend over said bedding component to secure said bedding component and said patient beneath said longitudinal straps; and spaced transverse attachment means for cooperation with said spaced fastening means on said longitudinal straps.

The invention will be readily understood with the following description of certain embodiments, by way of example, in conjunction with the accompanying drawings, in which.

Figure 1:
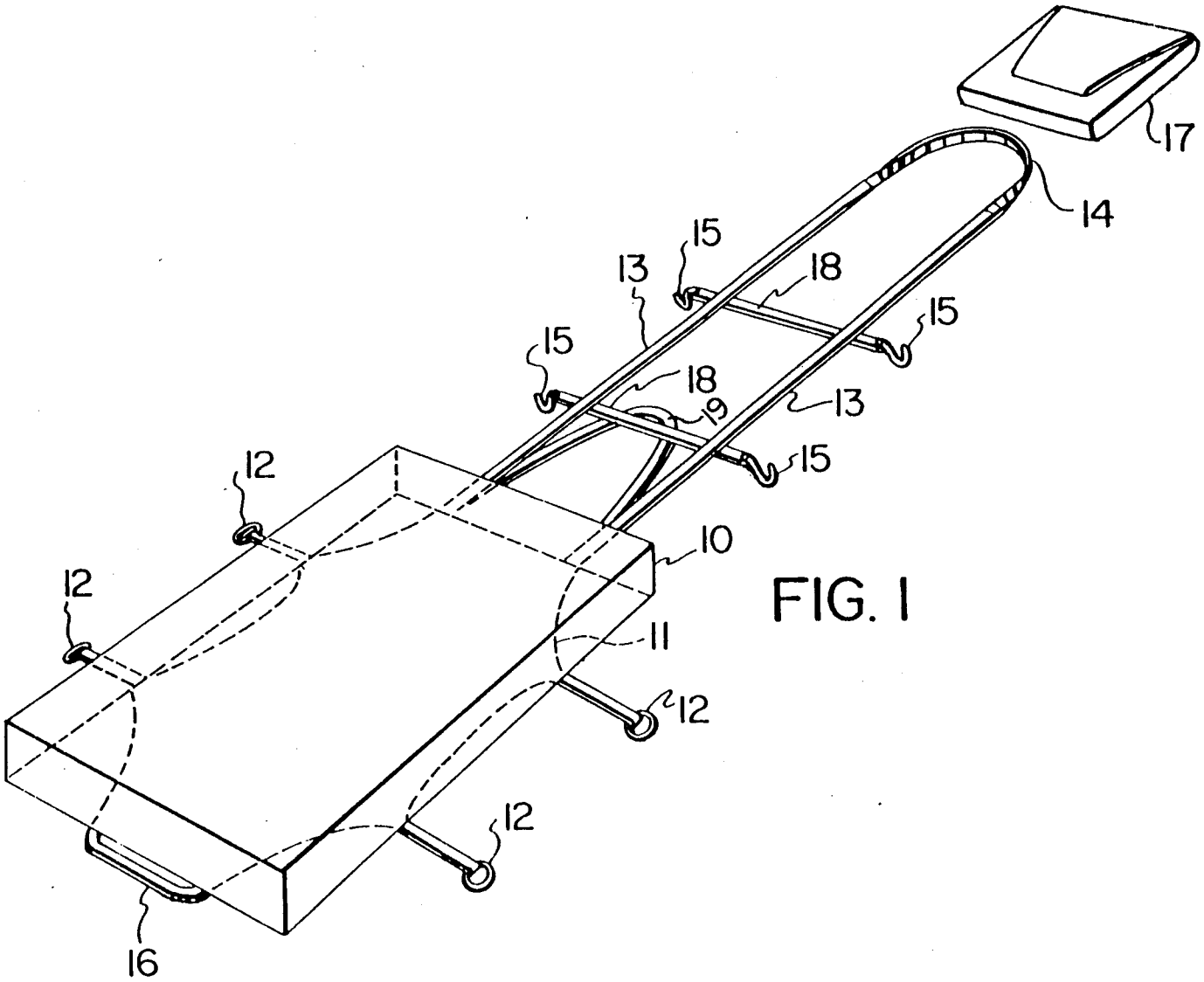
FIG. 1 is a perspective view of one form of harness in accordance with the invention, positioned relative to a mattress.
Figure 2:
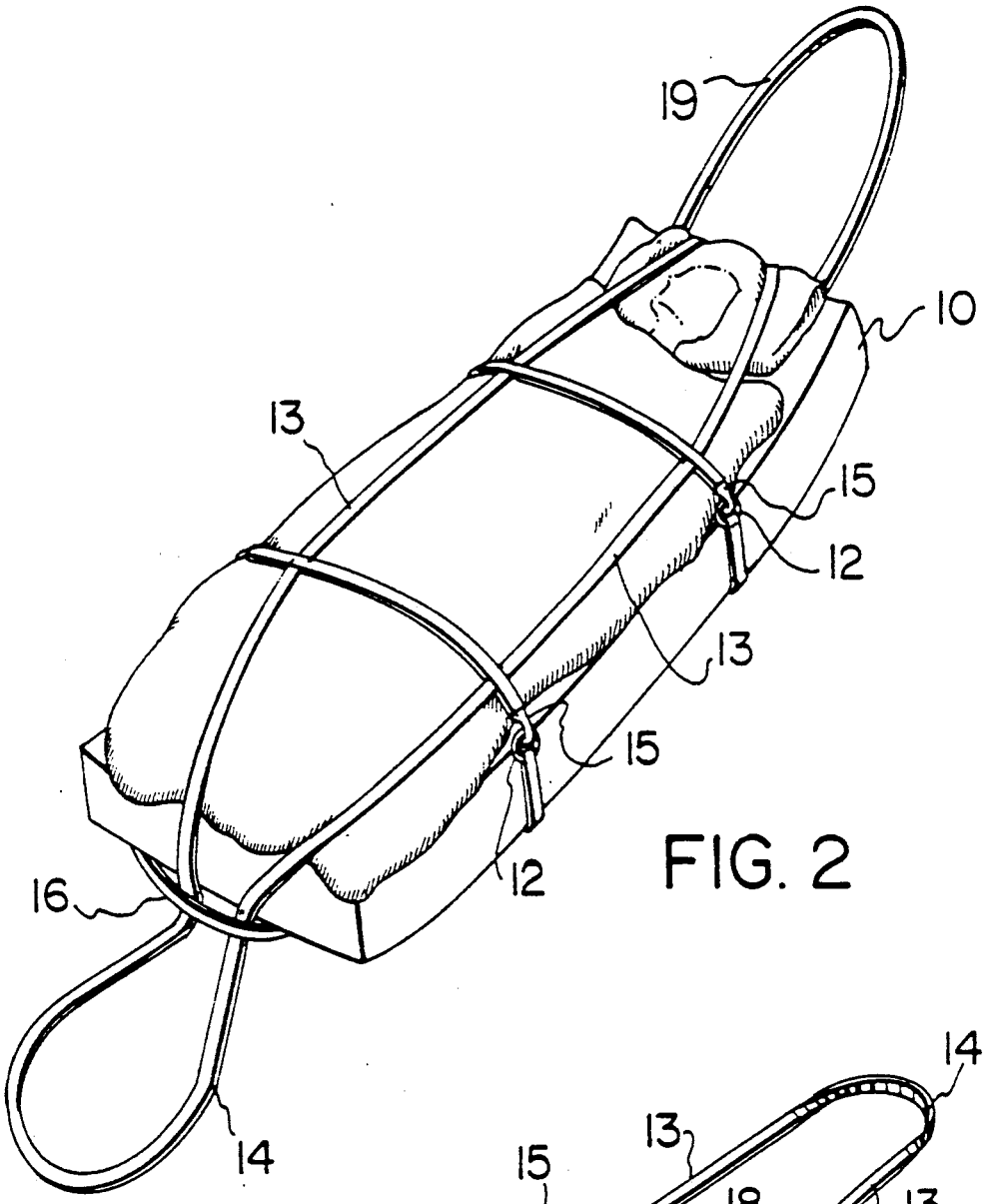
FIG. 2 is a perspective view of the harness of FIG. 1 in operation for evacuation.

FIGS. 1 and 2 illustrate a harness for use in combination with a mattress 10. A bottom harness member, which can be of varying form, is positioned beneath the mattress, being indicated, for example only, by a dotted outline 11. The harness member has attachment members 12 at each side, spaced apart along the sides. From one end, generally considered as the top or head end, two longitudinal straps 13 extend, ending, in the example, in a loop 14. On each strap 13 are positioned fastening members 15. The fastening members 15 are positioned on the straps 13 so as to connect to the attachment members 12 when the straps 13 are brought over the mattress 10 and the patient on the mattress. This is illustrated in FIG. 2.

A loop 16 at the other end of the harness member 11 provides an anchorage for the straps 13, the straps being passed through the loop. This is also illustrated in FIG. 2.

A form of the bottom harness member can vary. One particular example is a plurality of straps which extend longitudinally and laterally, or a piece of material which is shaped to approximate straps. Other examples can readily be appreciated. When the member 11 is composed of straps or the like form, the attachment members 12 are fastened to the ends of laterally extending straps or the like. The longitudinal straps 13 can conveniently be extensions of longitudinally extending straps of the member 11, or separate straps secured to the longitudinally extending straps.

The arrangement as illustrated in FIGS. 1 and 2 provides a harness which is very simple and is also effective. It can be applied readily to existing mattresses already positioned on a bed. The attachment members 12 need extend only a very short distance beyond the side of the mattress and therefore will not hang down very far and are not an inconvenience. The straps 13 can be rolled up and stored in a case, illustrated at 17, which in turn can be stored under the mattress, attached to the mattress, or once the straps are inside and the case closed, can hang down at the end of the mattress.

To maintain the straps 13 in position over a patient, and preventing sideways displacement as mattress and patient are moved, transverse ties, or similar members 18 can be provided. If provided, a preferred positioning is in alignment with the attachment members 12. A further loop 19, can be provided at the top or head end. The mattress and patient can be pulled by pulling on loop 14, as in FIG. 2, with control provided by loop 19. Alternatively, the mattress and patient can be pulled by loop 19, with control provided by loop 14.

Figure 3:
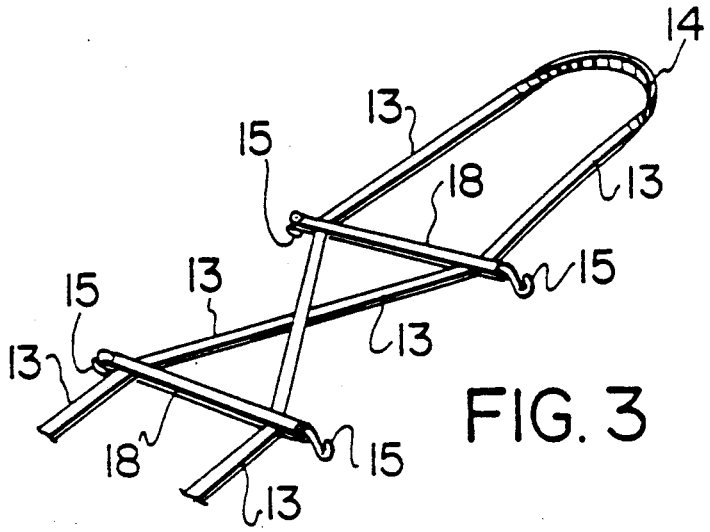
FIG. 3 is a perspective view of part of a harness, illustrating a modification thereof.

FIG. 3 illustrates a modification to the arrangement in FIG. 2. In FIG. 3, the straps 13 are crossed over between the transverse members or belts 18. This cross-over would be approximately over the lower part of a patient's arms and would act as an improved restraint.

In the example of FIGS. 1 and 2, the mattress would normally be enclosed in a cover, the covered mattress positioned on the bottom harness member. In an alternative arrangement, the harness can fit around the mattress. Such an arrangement is illustrated in FIGS. 4, 5 and 6.

Figures 4, 5, 6:
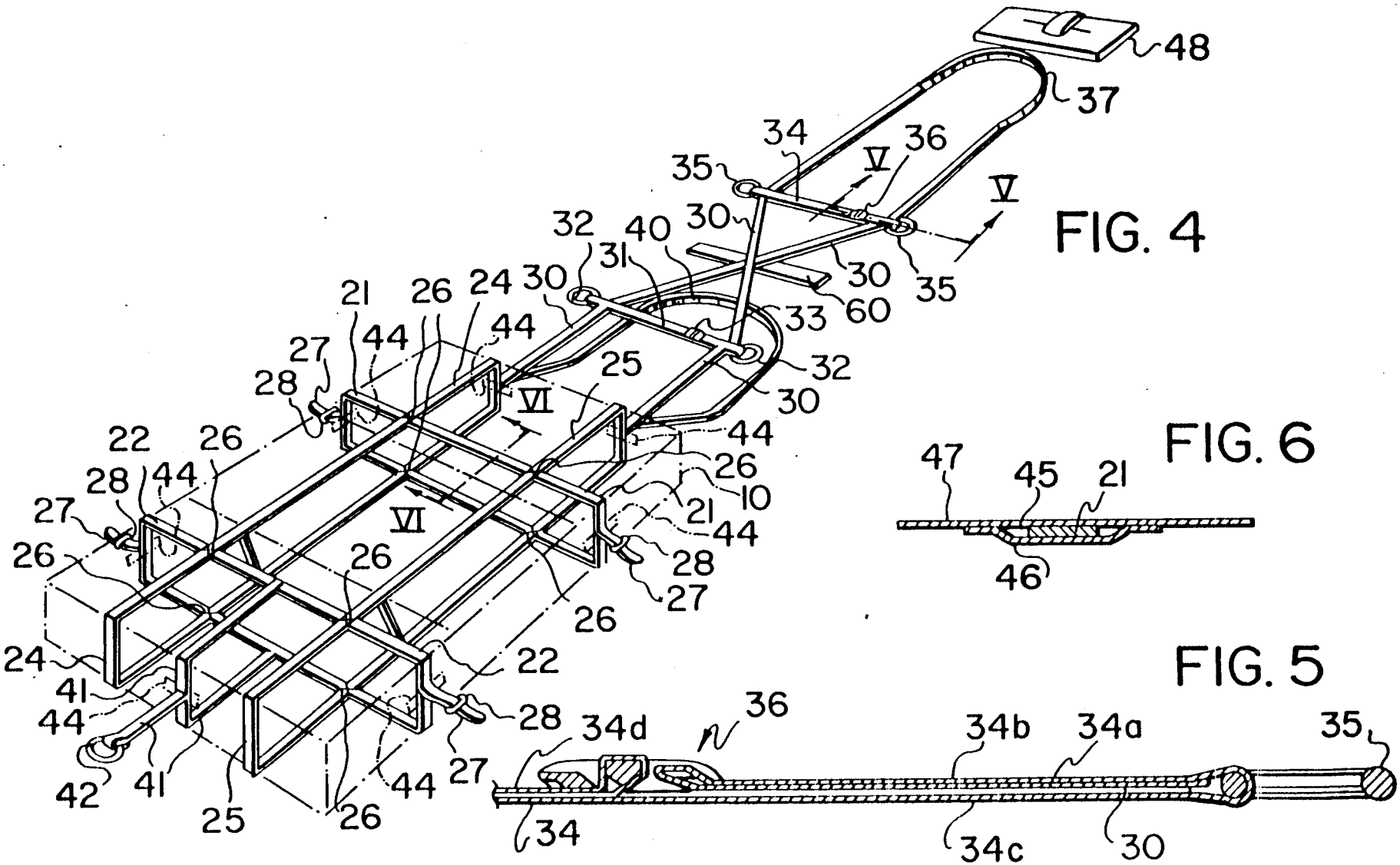
FIG. 4 is a perspective view of another form of harness in accordance with the invention.
FIG. 5 is an enlarged cross-section on the line 5—5 of FIG. 3.
FIG. 6 is an enlarged section on the line 6—6 of FIG. 4.

In FIG. 4, the mattress is illustrated in dotted outline at 10. A harness, in accordance with the present invention, comprises, in the example illustrated, two transverse straps 21 and 22 which are in the form of transversely extending loops. Also, in the example illustrated, two longitudinal straps 24 and 25 form two longitudinally extending loops. Where the transverse loops and the longitudinal loops cross each other, indicated at 26, they can be connected together, as by stitching or other means. In this arrangement, the bottom portions of the straps 21, 22, 24 and 25 form the bottom harness member. At each side, extending from each transverse loop, is a short strap 27, having a buckle or some other form of fastener, such as snap-hook fastener 28 at the other end. The short strap 27 can be separate sections of strap or can be formed by folding the transverse straps 21 and 22 back on themselves.

At one end of the mattress, extend two further, longitudinally extending straps 30. These straps 30, in a form similar to that illustrated in FIG. 3, extend for a short distance parallel to each other, being joined at the ends of the parallel sections by a first lateral looped belt 31 having a ring 32 at each end and a buckle 33 intermediate the ends. The straps 30 then cross over, and are then connected by a further lateral looped belt 34 having a ring 35 at each end and a buckle 36 intermediate the ends. The straps 30 then continue, being joined at the other ends to form a loop 37 which will serve as a handle. The lateral belts 31 and 34 are positioned such that when the straps 30 are brought up and over to overlie the mattress and a patient on the mattress, the loops 32 align with fasteners 28 on transverse straps 21, and loops 25 align with fasteners 28 on transverse strap 22 and are attached to the fasteners. The belts 31 and 34 can be tightened by means of the buckles 33 and 36. A further looped strap 40 can be provided at this end to act as a handle. At the other end a strap 41 and loop 42 extend and can be used to assist with pulling the mattress, and patient, in cooperation with a handle 37, the straps 41 extending to and being connected to the transverse strap 22.

A cross section through a buckle 36 is illustrated in FIG. 5. The loop 35 is shown attached to belt 34. Belt 34 extends in three layers, the end 34*a* being in the center, and extending through the buckle 26, back over as an outer section 34*b*, through loop 35 and back, as section 34*c*, across to the other side, where it passes through the other loop 35. The end then returns, passes through and back out of the buckle, the free end being shown at 34*d*. Pulling on the free end 34*d* will tighten the belt. A similar structure occurs for belt 31, loops 32, and buckle 34. One of the straps 30 is also shown in FIG. 4, the strap 30 and belts 31 and 34 being connected together where they cross, as by stitching.

The harness can be made of a unit which is fitted over a mattress, a mattress cover then being pulled over the mattress and harness. Openings will be required in the mattress cover, sides and ends, for the loop handle 37, strap 40, straps 30, straps 27 and fasteners 28, and straps 31, and loops 42, as indicated in dotted outline at 44.

In an alternative arrangement, the harness can be part of the mattress cover, the straps 21, 22, 24, 25 and 41 extending through channels formed on the mattress cover, for example. This is illustrated in FIG. 6, where transverse strap 21 is shown in a channel 45 formed by attaching a strip of material 46 to the mattress cover 47. Again, access as by the openings 44, is required for the loop handle 37, strap 40, straps 30, straps 27 and fasteners 28, and straps 41 and loop 42. A convenient manner of providing such access is by zip fasteners or by some other form of slit which can be readily opened and closed. The straps, and loops, can then be stored inside the mattress cover until required. The straps 30, belts 31 and 34, the loops and buckles, strap 37 and strap 40 can be stored in a case, shown at 48, which can be attached to the end of the mattress cover.

Figure 7:
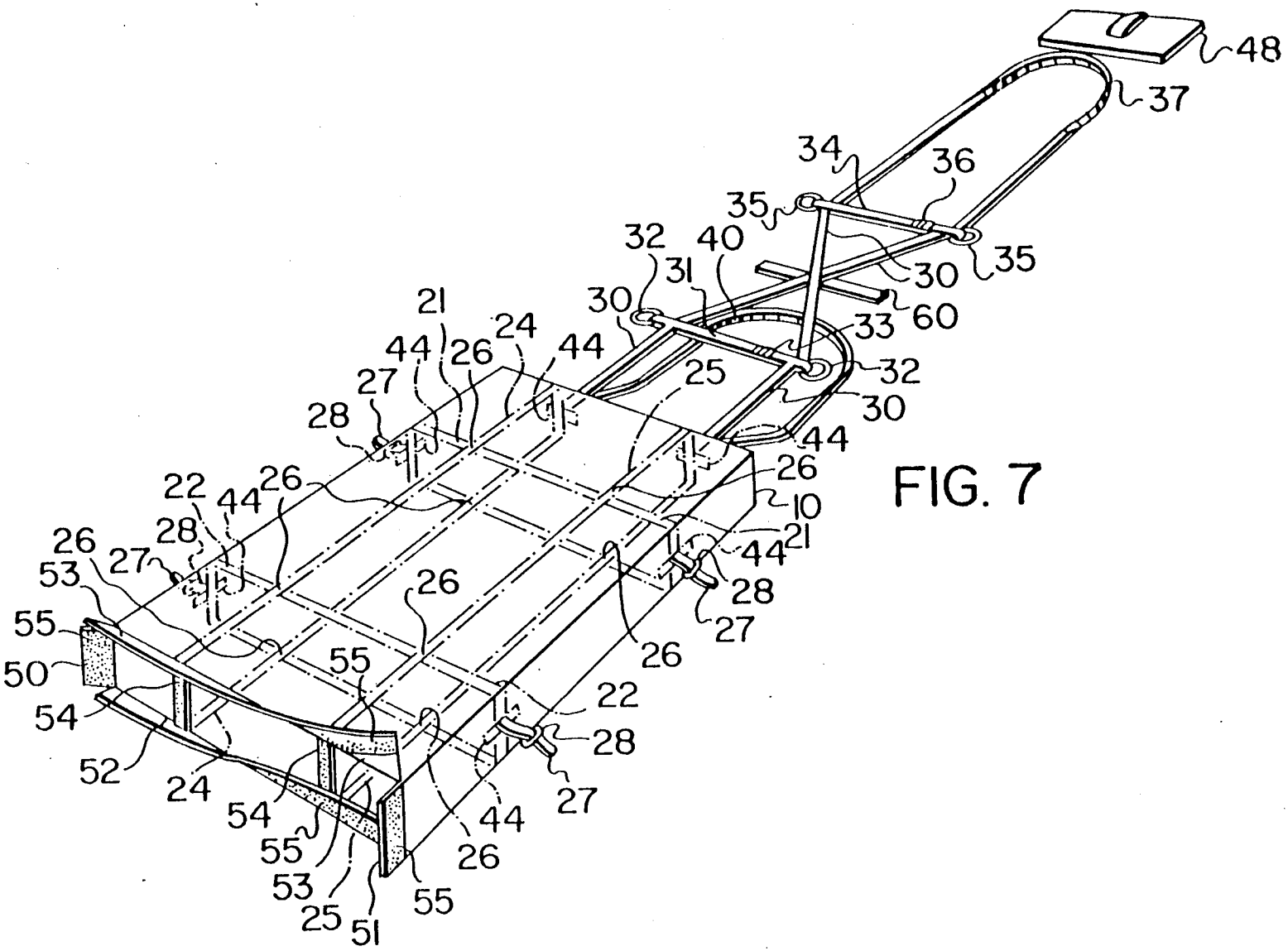
FIG. 7 is a perspective view of a further, alternative, embodiment.

In a further alternative arrangement, the harness is part of the mattress cover, with the harness being attached to the inside surface of the cover by, for example, sewing, at spaced apart positions. As illustrated in FIG. 7, in which the same reference numerals are used for items common to FIGS. 4 and 5, the harness can be attached to the cover at the cross over points 26. As shown in FIG. 7, the cover is openable at the end remote from the further longitudinally extending straps 30, being closed by flaps 50, 51, 52 and 53.

To insert a mattress, the loop ends 54 of the straps 24 and 25 are moved apart for insertion of the mattress. After the mattress is in position, the loop ends 54 are pulled round to extend over the mattress end. The opening is then closed by folding in the flaps 50, 51, 52 and 53. The flaps 50, 51, 52 and 53 have hook and loop and loop fastening material attached thereto as indicated at 55. By folding in the side flaps 50 and 51, then folding up flap 52 and folding down flap 53, the opening is securely fastened closed, but is readily opened.

A further strap and loop, as at 41 and 42 in FIG. 4, can be provided, but the strap 41 must be capable of being moved out of the way for insertion of the mattress. A suitable slit would be provided in flap 52.

The number of transverse straps can vary, more than two being provided. The form of the further longitudinally extending straps 30 and transverse belts 31 and 34 can also be varied. Only one longitudinal strap might be provided, with a single point of attachment of both ends of straps 30. The objective of the straps 20 and belts 31 and 34 is to safely retain the patient on the mattress while being moved. A single person can pull on the mattress by using the handle 37, in combination with loop 42. If the strap 40 is provided, this provides for a further person to assist in controlling movement, as down stairs, for example.

A strip of hook-and-loop material such as are marketed under the trade mark "Velcro" material 60 is attached to the straps 30 where they cross over, the strip extending generally laterally. This strip 60 can be wrapped round the wrists or lower arms just above the wrists of a patient to immobilize and thereby protect the arms and hands, if the arms of the patient are outside the bed clothes.

The harness can be applied in various ways. Thus, it can be applied over a mattress, which may be of a synthetic foam or other material safe to use. The harness can be positioned over the mattress and then a removable mattress cover positioned over the harness and mattress. In modifications as mentioned above, the harness can be attached to and be part of the removable mattress cover. Existing mattress covers can often be adapted, or readily adaptable, to the use of the harness, for example, by the provision of slits through which the various straps can extend. In such an arrangement, the harness is positioned over a mattress with a manual cover used and a further cover applied, with slits or similar openings for the straps.

Instead of a case 48, the straps 30, belts 31 and 34, buckles 33 and 36, strap 40 and strap 37 can be stored inside the end of the mattress cover. Alternatively, the case 48 can be stored inside the mattress cover, holding the belts, etc.

Figure 8:
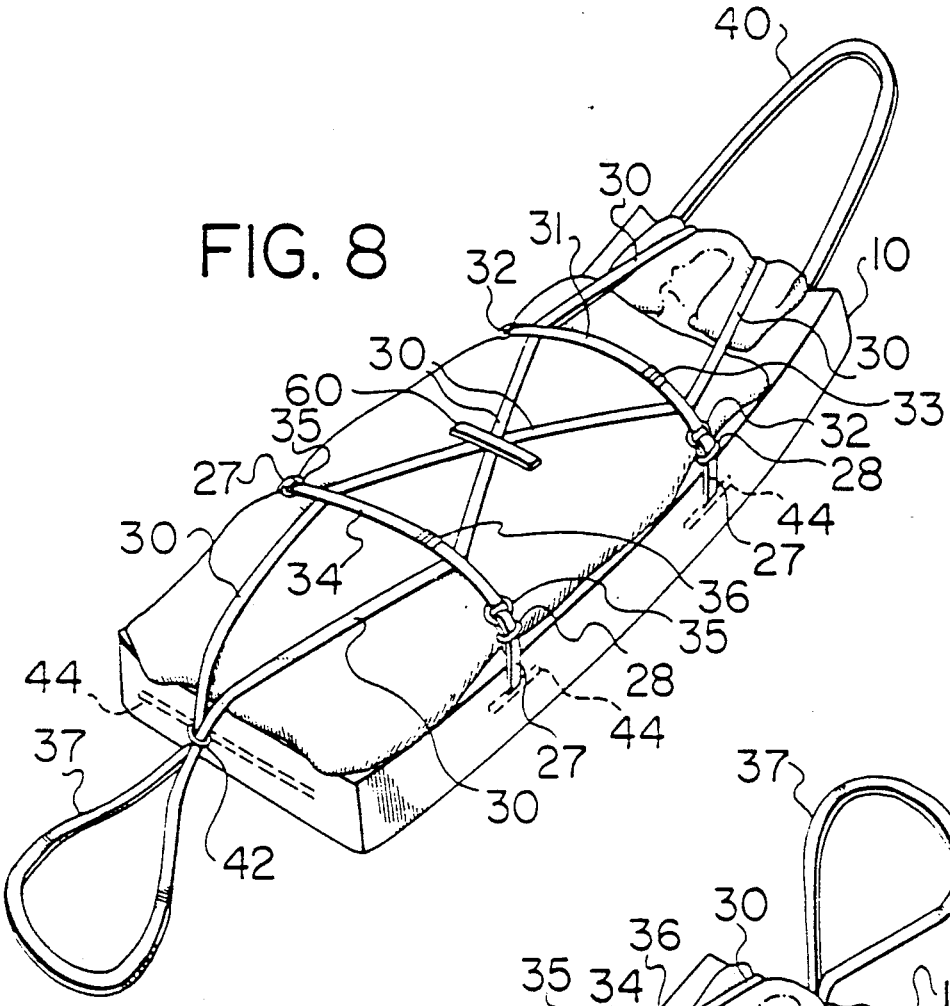
FIG. 8 is a perspective view showing the system of FIGS. 4, 5 and 6 in operation for evacuation purposes.
Figure 9:
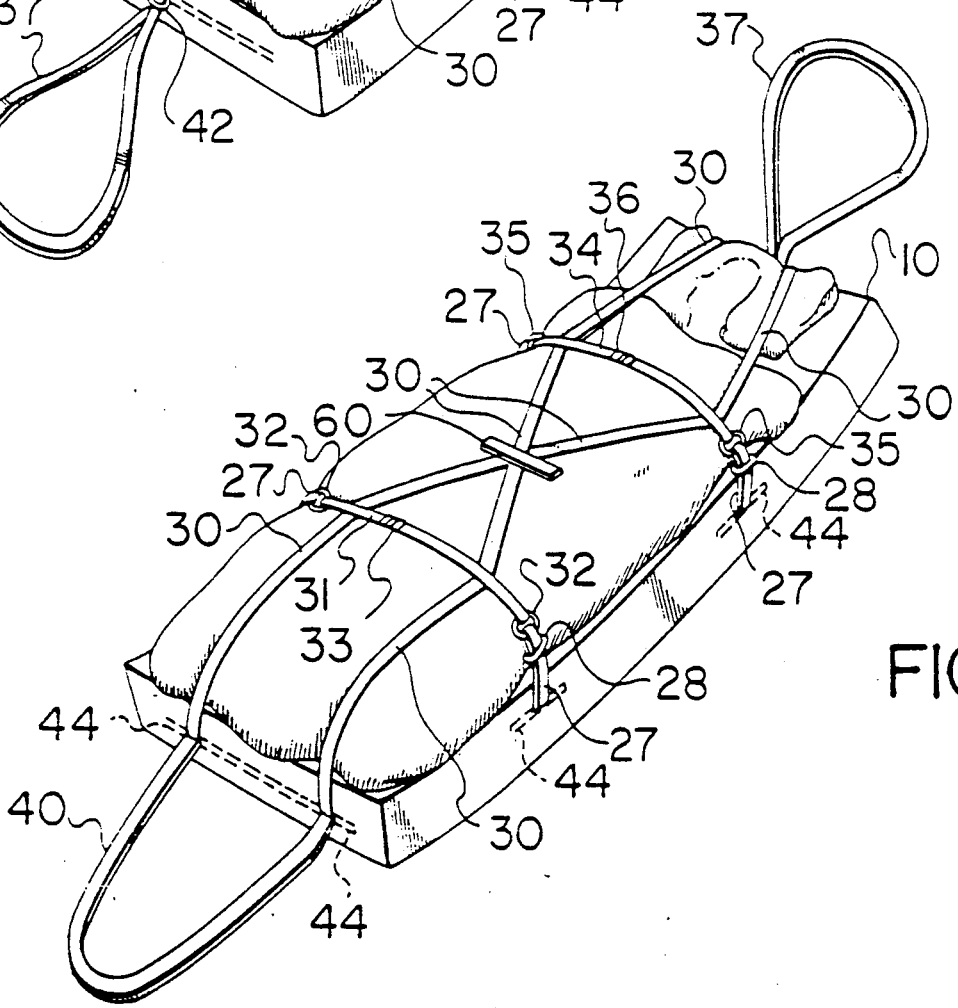
FIG. 9 is a view similar to FIG. 8, but showing evacuation using an opposed end of the mattress.

Illustrated in FIGS. 8 and 9 are methods of securing a patient in a mattress in the arrangements in FIGS. 4, 5, 6 and 7, and, as shown, the position of the patient's head relative to the mattress and harness does not influence the effectiveness of the harness assembly.

The harness in the arrangement of FIGS. 3, 4, 5 and 6, is enclosed, and during normal use, the mattress is completely covered, causing no inconvenience and is kept clean. No problem is met when the harness is needed as the straps 27 and fasteners 18 are inside the bed and will not create any problem by having to be threaded back through a bed frame before being fastened.

The straps of the harness can be of various materials, such as a webbing of cotton or synthetic material, rubber, including synthetic rubber, leather, or other material. Use of the mattress fitted with the harness in a sensitive area, such as in operating rooms, will require a selection of specific materials for the harness to eliminate the possible hazard of static electricity.

I claim:

1. An emergency evacuation harness for fitting over a mattress for moving immobile persons, said harness comprising:

a bottom harness member for positioning beneath a mattress;

spaced attachment means on each side of said bottom harness member;

a plurality of longitudinal straps extending from one end of said bottom harness member, said longitudinal straps extendable in use over said mattress and a patient on said mattress to the other end of said bottom harness member;

spaced fastening means on said longitudinal straps, said fastening means positioned to engage with said attachment means when said longitudinal straps extend over said mattress.

2. A harness as claimed in claim 1, including transverse members extending between said longitudinal straps and attached thereto.

3. A harness as claimed in claim 2, said transverse members aligned with said fastening means.

4. A harness as claimed in claim 1, including means at the other end of said bottom harness member for connecting said longitudinal straps to said bottom harness member when said longitudinal straps extend over said mattress.

5. A harness as claimed in claim 1, comprising two longitudinal straps, said longitudinal straps extending to form a loop at ends remote from said bottom harness member.

6. A harness as claimed in claim 1, including a loop formed at the other end of said bottom harness member.

7. A harness as claimed in claim 1, said bottom harness member comprising a plurality of transverse straps and a plurality of longitudinally extending straps, forming a grid-like structure.

8. A harness as claimed in claim 7, with longitudinal straps extending from said longitudinally extending straps.

9. An emergency evacuation harness for fitting around a mattress for moving immobile persons, said harness comprising:

a plurality of transverse straps, each forming a transversely extending loop adapted to transversely envelope said mattress;

at least one longitudinal strap forming a longitudinally extending loop adapted to longitudinally envelope said mattress, said longitudinally extending loop and said transversely extending loops forming a grid-like structure;

attachment means on each said transverse loops, said attachment means at each side;

further longitudinal straps extending from one end of said harness, and connected to said longitudinally extending loop at said one end, and adapted to overlie a patient on said mattress;

fastening means on said further longitudinal straps, said fastening means positioned to align with and connect to said attachment means when said further longitudinal straps extend over said transversely extending loops from said one end to the other end; whereby said longitudinally extending loop and said transverse loops are adapted to hold said mattress in said harness, and said further longitudinal straps, with said attachment means and said fastening means, are adapted to hold a patient on said mattress.

10. A harness as claimed in claim 9, including two longitudinal straps forming two longitudinally extending loops, a further longitudinal strap extending from and connected to one end of each longitudinally extending loop.

11. A harness as claimed in claim 9, said further longitudinal straps extending to form a loop.

12. A harness as claimed in claim 9, including transverse belts extending laterally between said fastening means, a fastening means at each end of each belt.

13. A harness as claimed in claim 12, said transverse belt including releasable tightening means.

14. A harness as claimed in claim 12, including a case at said one end, said further longitudinal straps, said transverse belts and said fastening means stored in said case.

15. A harness as claimed in claim 9, said attachment means connected to said transverse loops by short straps.

16. A harness as claimed in claim 9, including an additional strap at said one end, the additional strap forming a handle.

17. A harness as claimed in claim 9, including a strap extending from the other end of said harness and attached to a transverse belt, and a loop at a free end thereof for pulling said harness and said mattress.

18. A harness as claimed in claim 9, said longitudinal straps and transverse straps connected together at cross over positions.

19. A harness as claimed in claim 9, adapted to fit around a mattress beneath a mattress cover.

20. A harness as claimed in claim 19, the straps extending in pocket channels on an inner surface of said mattress cover.

21. A harness as claimed in claim 19, including access openings at sides and ends of said mattress cover for access to said attachment means and said further longitudinal straps.

22. A harness as claimed in claim 21, said access openings comprising openable and closable slits in said mattress cover.

23. A harness as claimed in claim 9, including a mattress cover, transverse straps and longitudinal straps attached to the mattress cover.

24. A harness as claimed in claim 22, said harness attached to an inner surface of said mattress cover, and having an opening at an end remote from said one end, and means for closing said opening.

25. A harness as claimed in claim 24, said opening being rectangular, and means for closing said opening comprising a plurality of flaps, one on each side of said opening, and means for releasably holding said flaps in an overlapping closed position.

26. A harness as claimed in claim 25, said means for releasably holding said flaps comprising hook and loop material.

27. A harness as claimed in claim 23, including a mattress in said mattress cover.

28. A harness as claimed in claim 9, including a case at said one end, said further longitudinal straps and fastening means stored in said case.

29. The harness of claim 9, incorporated into a mattress cover adapted to be mounted on a mattress.

30. In an emergency evacuation harness for fitting over a bedding component and a patient for moving immobile persons, the improvement comprising:

a harness assembly adapted to overlie a bedding component, said assembly having:

a plurality of longitudinal straps extending from one end of said bedding component, said longitudinal straps extendable in use over said bedding component from one end thereof to an opposed end and to overlie a patient on said bedding component;

transverse means including longitudinally spaced side attachment means;

longitudinally spaced fasting means on said longitudinal straps positioned to engage with said side attachment means when said longitudinal straps extend over said bedding component to secure said bedding component and said patient beneath said longitudinal straps.

31. A harness as claimed in claim 30, including transverse members extending between said longitudinal straps and attached thereto.

32. A harness as claimed in claim 30, comprising two longitudinal straps, said longitudinal straps extending to form a loop at ends remote from said bedding component.

33. A harness as claimed in claim 30, including a loop formed at the opposed end of said bedding component.

34. A harness as claimed in claim 30, said harness having a plurality of transverse straps together with said plurality of longitudinally extending straps forming a grid-like structure.

* * * * *